US006886771B2

(12) United States Patent
Göbbels et al.

(10) Patent No.: US 6,886,771 B2
(45) **Date of Patent: *May 3, 2005**

(54) CONICAL CHEESE AND METHOD OF FORMING THE PACKAGE OF A CONICAL CHEESE

(75) Inventors: Heinz-Dieter Göbbels, Mönchengladbach (DE); Gregor Gebald, Mönchengladbach (DE); Friedemann Soll, Mönchengladbach (DE)

(73) Assignee: Saurer GmbH & Co. KG, Moenchengladbach (DE)

( * ) Notice: Subject to any disclaimer, the term of this patent is extended or adjusted under 35 U.S.C. 154(b) by 0 days.

This patent is subject to a terminal disclaimer.

(21) Appl. No.: 10/325,131

(22) Filed: Dec. 20, 2002

(65) Prior Publication Data

US 2003/0116673 A1 Jun. 26, 2003

(30) Foreign Application Priority Data

Dec. 20, 2001 (DE) ..... 101 62 778

(51) Int. Cl.[7] ..... B65H 34/38; B65H 34/32

(52) U.S. Cl. ..... 242/477.3; 242/483.6; 242/480.9; 242/178

(58) Field of Search ..... 242/477.3, 483.6, 242/480.9, 178

(56) References Cited

U.S. PATENT DOCUMENTS

| | | | | |
|---|---|---|---|---|
| 954,344 A | | 4/1910 | Rhoades | |
| 1,789,702 A | | 1/1931 | Fromonot | |
| 2,281,747 A | | 5/1942 | Campbell | 242/43 |
| 2,301,713 A | | 11/1942 | Seem et al. | 242/159 |
| 3,402,898 A | | 9/1968 | Mattingly | 242/43 |
| 3,638,872 A | * | 2/1972 | Jennings | 242/477.3 |
| 3,991,950 A | | 11/1976 | Tashiro et al. | 242/18 |
| 4,102,506 A | | 7/1978 | Raasch et al. | 242/18 |
| 4,266,734 A | | 5/1981 | Raasch | 242/18 |
| 4,771,960 A | | 9/1988 | Yamamoto et al. | 242/18.1 |
| 6,065,712 A | * | 5/2000 | Mayer et al. | 242/477.2 |
| 6,443,379 B2 | * | 9/2002 | Lassmann | 242/178 |
| 2002/0040946 A1 | | 4/2002 | Lassmann | 242/477.5 |

FOREIGN PATENT DOCUMENTS

| | | |
|---|---|---|
| CH | 575 878 | 11/1976 |
| CH | 597 075 | 10/1977 |
| DE | 2 330 650 | 6/1973 |
| DE | 26 32 014 | 7/1976 |
| DE | 38 25 413 A1 | 1/1990 |
| DE | 43 10 905 A1 | 6/1994 |
| DE | 100 15 933 | 3/2000 |
| JP | 08282916 | 10/1996 |
| JP | 2000335824 | 5/2000 |

OTHER PUBLICATIONS

German Search Report.
European Search Report.

* cited by examiner

*Primary Examiner*—Kathy Matecki
*Assistant Examiner*—Evan Langdon
(74) *Attorney, Agent, or Firm*—Kennedy Covington Lobdell & Hickman, LLP

(57) ABSTRACT

A method for forming the wound package of a conical cheese on rotor spinning machines, wherein a crossing angle $\alpha_M$ in a central zone of the bobbin traverse is less than 28° and a crossing angle $\alpha_R$ in the end zones located adjacent the ends of the wound package is increased in respect to the central zone. The cylindrical cheeses thereby produced are distinguished by long running lengths, solid structure, good density distribution and excellent unwinding properties.

8 Claims, 3 Drawing Sheets

CONICAL CHEESE AND METHOD OF FORMING THE PACKAGE OF A CONICAL CHEESE

CROSS-REFERENCES TO RELATED APPLICATIONS

This application claims the benefit of German patent application DE P 10162778.5 filed Dec. 20, 2001, herein incorporated by reference.

BACKGROUND OF THE INVENTION

The present invention relates to a conical cheese and a method of forming the wound package of a conical cheese with a yarn guide device.

Yarn manufactured on rotor spinning machines differs from ring-spun yarn in its winding buildup behavior and in its unwinding behavior. Rotor yarn is less hairy than ring-spun yarn and can, therefore, be more easily unwound (easier release). However, the rotor yarn has a greater tendency to roll than ring-spun yarn, causing the wound yarn in the edge area of the cheese to be pressed to the outside by the yarn layers above it. As a result, a cheese can be formed that exceeds the normal winding traverse of, e.g., 150 mm and can grow to a width of 170 to 180 mm. Consequently, the end surfaces that are desired are no longer produced. Such phenomena occur with yarns made of natural fibers such as cotton, and especially with coarse yarns. Coarser yarns produce a more marked distortion of the end surfaces.

Problems can also occur on the end surfaces of wound packages in the preliminary stage of yarn manufacture in the case of wound fiber slubbings or roving yarns. U.S. Pat. No. 954,344 discloses that bulges will occur in winding construction on the end surfaces if slubbings or roving yarns are not twisted or are only slightly twisted. This problem occurs even though the displacement angle is more than 32°, which is customary in the prior art. This problem is exacerbated by the soft and loose structure of the fiber strands. Bulges can have a significant adverse effect on the further processing of the packages. According to U.S. Pat. No. 954,344, the bulges can be prevented by increasing the displacement angle, which otherwise remains the same, in the edge area of the package.

If cheese winding is performed at high yarn speeds in the cross winding, it can occur with average and coarse yarns, because of the inertia of mass, for the yarn to move past the bobbin edge at the deflection points of the traverse movement and to create a so-called skipped yarn defect. This defect leads to yarn breaks and hinders the further processing of the yarn.

The probability of the occurrence of such defects is significantly influenced by crossing angle $\alpha$. Therefore, in the manufacture of cheeses the selection of the particular yarn crossing angle is of great significance. When a cheese is produced by "random winding," the yarn crossing angle remains constant over the entire winding travel. On the other hand, when a cheese is produced using "precision winding," the yarn crossing angle decreases with the increasing cheese diameter. The advantages of precision winding are, among other things, the fact that a cheese produced using precision winding has more running length, given the same bobbin volume, than a cheese produced using random winding. However, the crossing angle, which decreases with increasing cheese diameter, limits the permissible maximum diameter when manufacturing precision bobbins of staple fiber yarns since the winding cannot be carried out with small crossing angles with staple fiber yarns in order to avoid the defects occurring on the edges. For this reason, crossing angles of less than 28° should be avoided during rotor spinning, as described, e.g., in German Patent Publication DE 100 15 933 A1. Consequently, precision winding, especially when winding staple fiber yarns, can be used only under very limited conditions.

In a third winding type referred to as "stepwise precision winding," the goal is a crossing angle that remains approximately the same over the winding travel. Even with stepwise precision winding, the above-described density problems and problems with the stability of the bobbin edge are only somewhat reduced in practice, but are not eliminated.

Generic German Patent Publication DE-AS 26 32 014 shows a conical cheese driven by circumferential friction from a roller. The drive roller has a narrow friction zone, having an elevated coefficient of friction, extending somewhat out of its middle surface. Ideally, the drive should take place only in the predetermined area of the friction zone of the cheese. However, the winding cheese can make contact, as the bobbin diameter increases, with the parts of the roller-shaped drive device that are located to the left and to the right of the predetermined friction zone. Consequently, the bobbin is no longer driven only in the friction zone, but is also driven at other locations on the circumference of the cheese. Since the length of the bobbin circumference viewed over the bobbin axis is different with conical bobbins, the speed of the cheese can fluctuate and become uncontrollable. In order to avoid this, the yarn crossing angle of the cheese represented in German Patent Publication DE-AS 26 32 014 and in parallel U.S. Pat. No. 4,266,734 is designed to be reduced in a limited range opposite the narrow friction zone of the drive roller in comparison to the yarn crossing angle outside of this friction zone. Consequently, the wound package's resistance to pressure is slightly increased in the predetermined, limited area. In addition, the friction zone of the drive roller and the area with a reduced yarn crossing angle of the conical cheese remain narrow.

New machine techniques, especially in the weaving mill, such as, e.g., air-jet weaving machines, place increased demands on the unwinding properties of the yarn. The requirements cannot be met, or are only insufficiently met, with the known winding constructions.

SUMMARY OF THE INVENTION

It is accordingly an object of the present invention to provide a conical cheese that is improved in comparison to known conical cheeses, and to provide a method of manufacturing the cheese on rotor spinning machines, especially when producing coarse yarns.

This object is addressed by a method of winding a yarn onto a bobbin tube into the form of a conical yarn cheese, wherein a yarn guide is traversed along the bobbin tube for winding the yarn onto the bobbin tube at a yarn crossing angle $\alpha$ which changes as the formation of the cheese progresses, with the traversing of a yarn guide executing a lesser crossing angle $\alpha_M$ in a central zone centrally along the bobbin tube between about 15° and about 28°, and a greater crossing angle $\alpha_R$ in end zones outwardly of the central zone adjacent opposite ends of the bobbin tube.

The present invention is based upon the knowledge that it is possible by having crossing angles in the edge area of the cheese that are larger than the crossing angle in the central part to distinctly reduce the crossing angle in the remaining wider central part in comparison with customary crossing angles without having to accept the disadvantages that occur when the crossing angle is reduced over the entire winding width. The reduction of the crossing angle can be considerable without resulting in an impermissible compaction of the cheese.

The present invention results in an improved unwinding of the yarn from the cheese. In accordance with the present invention, the yarn unwinding process is smoother with fewer loops and yarn entanglements, thereby permitting higher yarn unwinding speeds. The bobbin buildup, especially on the end surfaces of the cheese, is improved. Finally, with the same bobbin diameter, the traveling length of the yarn is distinctly increased in comparison to a customary bobbin of the same winding type.

In accordance with a preferred embodiment of the present invention, the crossing angle $\alpha$ enables an increase of the wound yarn length, while maintaining excellent stability and high density of the conical package. Crossing angle $\alpha$ advantageously and constantly increases from crossing angle $\alpha_M$ of the central zone to crossing angle $\alpha_R$ of the end zones. Each end zone can be sized so that it occupies not more than about 15% each of the entire winding width $B_{WG}$ of the cheese.

In accordance with another feature of the present invention, the undesired high yarn tension in connection with crossing angles a that are less than 28° can be suppressed by reducing the bobbin contact pressure and yarn tension as the bobbin diameter increases. The bobbin contact pressure is known to be composed of the weight of the bobbin and the weight of the bobbin frame (more commonly known as the creel), as well as of the force resulting from the torque applied, e.g., by a torque-imparting device. The bobbin contact pressure can be reduced in such a manner that not only is the bobbin weight compensated, but a removal of load also occurs.

If a yarn guide that is moved back and forth, e.g., a belt yarn guide, is already present at a winding head for producing the traversing movement, and the yarn guide's speed can be controlled separately from the bobbin speed, the method of the present invention for producing a cheese can be readily carried out by the appropriate arranging and/or programming of the control without additional construction costs and without replacing yarn guidance elements.

The present invention also permits the winding of coarse yarns with relatively small crossing angles. For example, the processing of cotton yarn with a metric count of 20 with a crossing angle $\alpha$ of 25° is still possible, along with the good unwinding properties and long running lengths. Improved unwinding properties result in a reduction of downtimes by lowering the number of yarn breaks in the further processing of the yarn bobbins. The greater running length associated with the reduction of the crossing angle increases the amount of yarn wound on a conical cheese by approximately 15% to 25% in accordance with the present invention in comparison to a customary bobbin with the same bobbin diameter. This results in a distinct reduction in the number of bobbins of a batch of cheeses. In addition, this leads to a reduction not only in downtimes for the bobbin replacement at the spinning locations and winding heads, but also a reduction in the transport costs and transport volumes during bobbin transport. In addition, the expense for handling the bobbins in subsequent yarn processing procedures can be lowered.

The present invention improves productivity, lowers costs and increases efficiency of yarn production and yarn processing.

Further details, features and advantages of the present invention will be explained in the following description of a preferred embodiment with reference to the accompanying drawings.

DESCRIPTION OF THE PREFERRED EMBODIMENT

Figure 1:
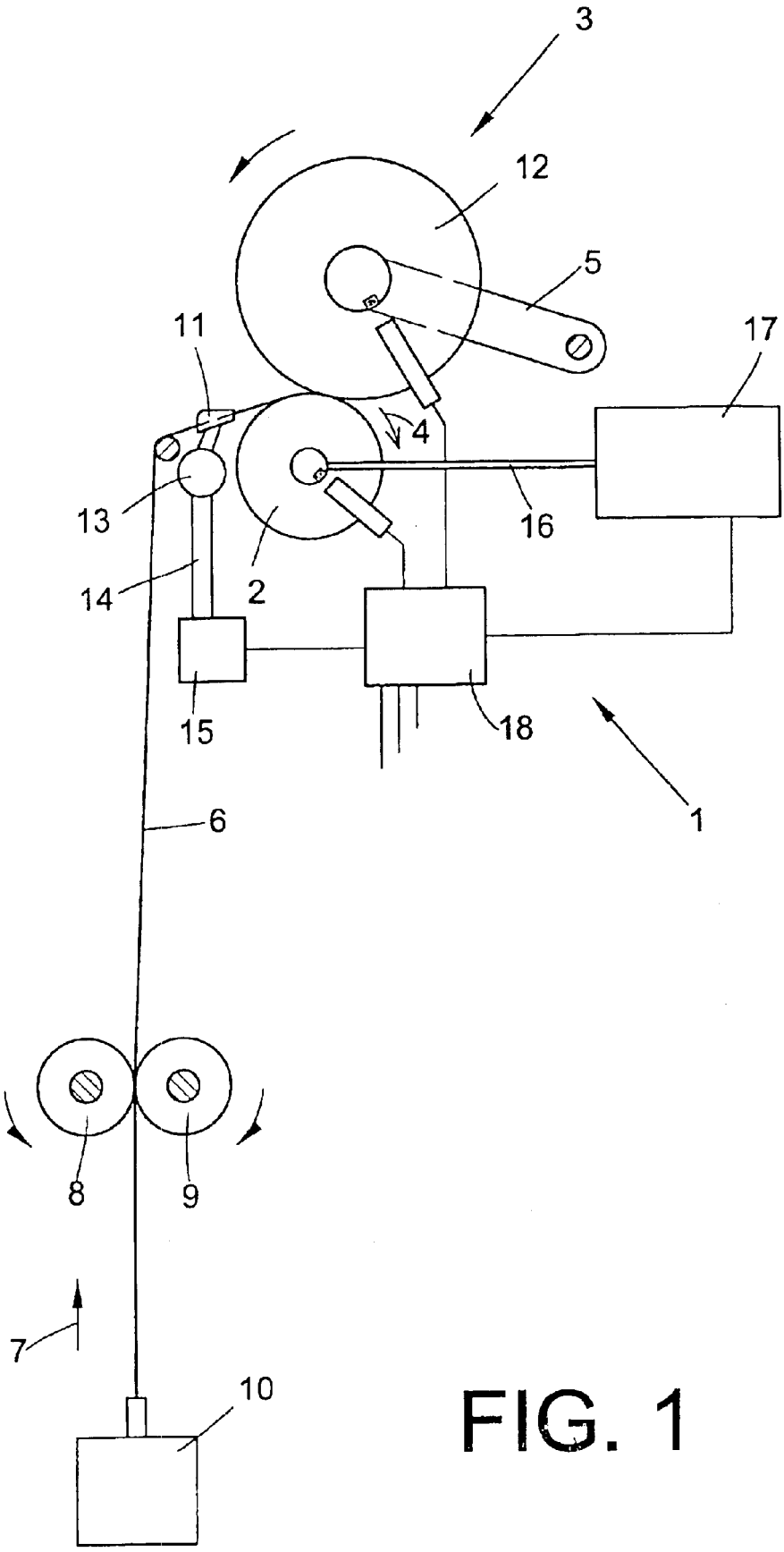
FIG. 1 is a simplified schematic side elevational view of a spinning head for executing the method of the present invention.

FIG. 1 shows winding device 1 on a spinning head of a rotor spinning machine that manufactures conical cheeses. The winding device 1 comprises roller 2 that drives the conical cheese 3 by means of friction. Roller 2 rotates in the direction of arrow 4. The cheese 3 is held by pivotable creel 5 and rests on roller 2. Roller 2 is loaded by a contact pressure from the resting cheese 3. Yarn 6 is drawn off at a constant yarn speed in the direction of arrow 7 by means of a cooperating pair of unwinding rollers 8, 9 and is wound via the yarn guide 11 moving yarn 6 back and forth to form a package 12 of cheese 3. The yarn guide 11 is part of traversing device 13, which is connected by means of an operative connection 14 to the motor 15, and is driven by the motor. Roller 2 is driven via the shaft 16 by a motor 17. The motor 15 and motor 17 are controlled by a microprocessor 18, wherein the crossing angle $\alpha$ of the yarn on the conical cheese 3 can be controlled during the particular winding traverse as a function of the position of the yarn guide 11.

Figure 2:
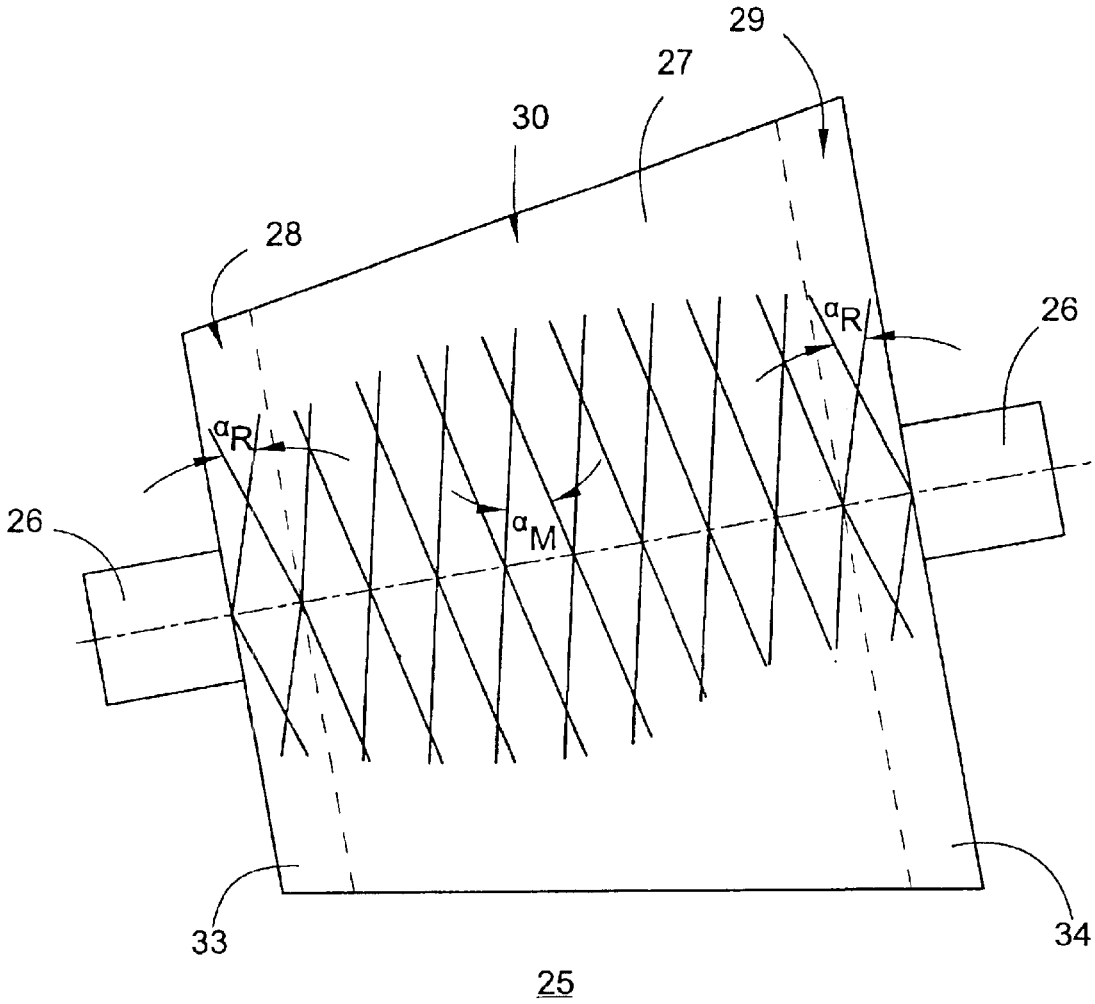
FIG. 2 is a simplified elevational representation of a conical cheese in accordance with the present invention.

The conical cheese 25 shown in FIG. 2 shows a yarn package 27 wound in accordance with the present invention onto a bobbin tube 26. The package 27 comprises in each end zone 28, 29 a cross winding with crossing angle $\alpha_R$ and, in the central zone 30, a cross winding with crossing angle $\alpha_M$. In the preferred embodiment of FIG. 2, the crossing angle $\alpha_R$ is 35° and the crossing angle $\alpha_M$ is 25°.The width of zone 30 (i.e., lengthwise along the yarn package) and of edge zones 28, 29 is marked by a dashed line. The conical wound package 27 is shown in a simplified basic view, wherein the course of the wound yarn 6 is only partially indicated, but reflects the crossing angles a of different sizes. In the preferred embodiment, the width $B_{WG}$ of the cheese 25 from left bobbin end edge 33 to right bobbin end edge 34 is 150 mm. The width $B_{WG}$ corresponds to one traverse of the yarn guide 11.

Because of forces of inertia that can become active at the high speeds of the traversing movement (i.e., back-and-forth movement) of the yarn guide 11, even given the relatively low mass of the yarn 6, especially with coarse yarns, the transition from one value of crossing angle $\alpha$ to another value takes place gradually rather than abruptly, as illustrated in FIG. 2. Consequently, the representation in FIG. 3 comes closer to the actual embodiment of the crossing angle $\alpha$ of the cheese 25 and to the yarn course on the surfaces, than the representation in FIG. 2.

Figure 3:
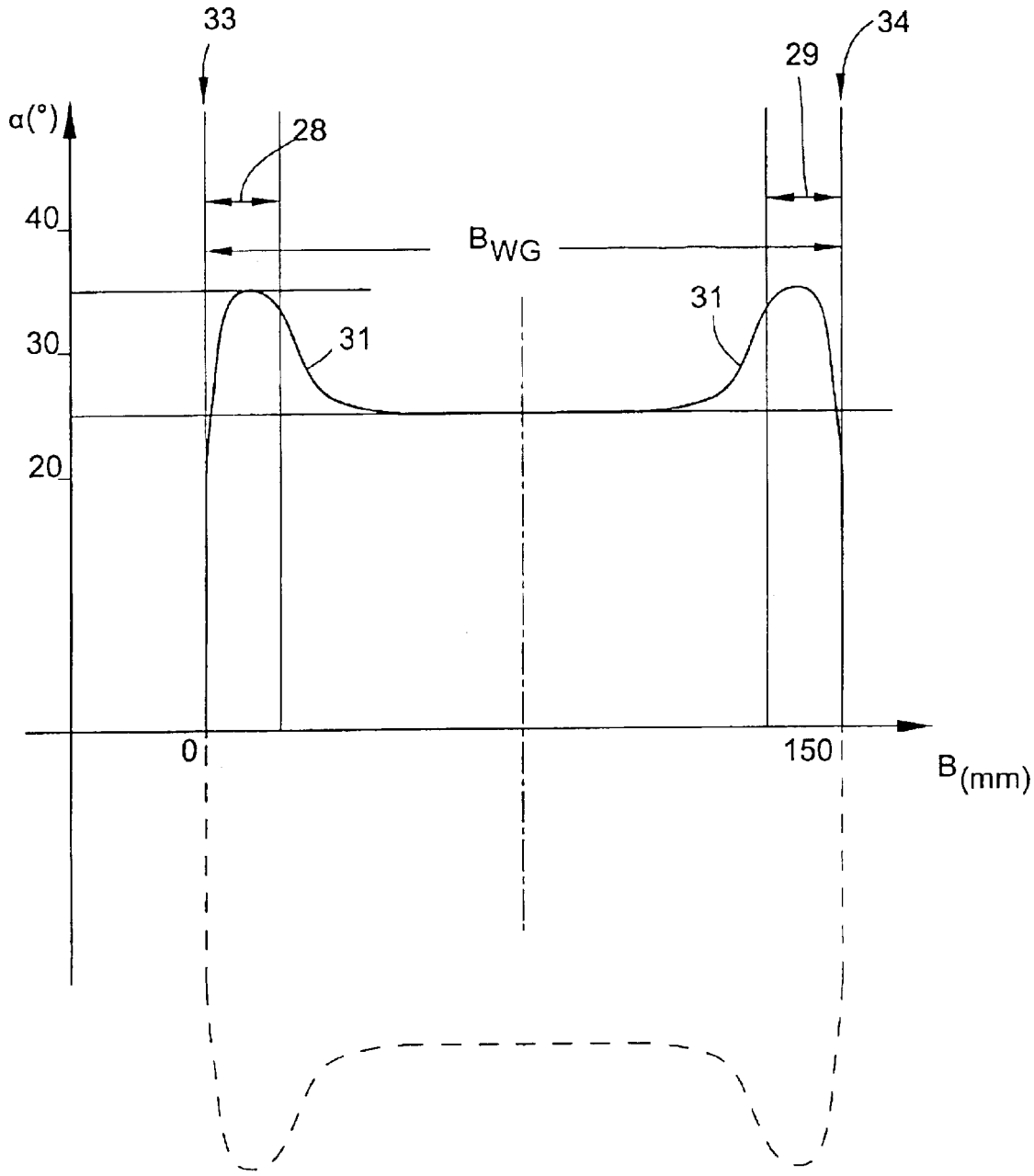
FIG. 3 is a graph representing the course of crossing angle $\alpha$ during a traverse in the form of a curve.

FIG. 3 shows the course of the magnitude of crossing angle $\alpha$, represented in the form of a curve 31 over winding width $B_{WG}$ of conical cheese 25. The values represent the traverse of yarn guide 11 in FIG. 2 from left to right (traverse of yarn guide 11 during the forward portion of the back-and-forth movement). At the left reversal point of yarn guide 11 and at the left bobbin end edge 33, the crossing angle $\alpha$ passes through the zero point and reaches the value of $\alpha_R$=35° in left end zone 28. From the crossing angle $\alpha_R$=35°, the value decreases after a transitional range to crossing angle $\alpha_M$=25°. The value of crossing angle $\alpha_M$=25° is held constant in central zone 30. On the right side of the cheese 25, the value of crossing angle $\alpha_M$=25° increases to $\alpha_R$=35° in the right end zone 29, and subsequently passes through the zero point again at the right reversal point of the yarn guide 11, and/or at the right bobbin end edge 34. The width of central zone 30, in which crossing angle $\alpha$ is at the value of $\alpha_M$=25°, takes up more than 60% of winding width $B_{WG}$. The course of the size of crossing angle $\alpha$ during the traverse of the yarn guide 11 in the return movement to the left is indicated in FIG. 3 by dashed lines.

The crossing angle $\alpha$ is set in a manner which is known, and therefore is not explained in detail herein. The crossing angle $\alpha$ is set by controlling the speed of rotation of the cheese 3, 25 and the speed of the traversing motion of yarn guide 11 during the course of the traverse. The conical cheese 25, which has been manufactured with a crossing angle $\alpha$ of $\alpha_R$=35° in end zones 28, 29, has stable bobbin edges 33, 34 without an impermissibly high contact pressure being exerted. Consequently, bulges on the front surfaces of cheese 25 are prevented. The advantageously small crossing angle $\alpha$ of $\alpha_M$=25° in the central zone 30 located between end zones 28, 29 makes possible a greater running length with a stable wound package having the same finished diameter, e.g., 300 mm, of the cheese 25 and containing 15% to 25% more yarn than customary bobbins with the same diameter.

The unwinding behavior of the cheese 3, 25 is improved by a smoother yarn course and the suppression of loop formation and yarn entanglements.

The present invention is not limited to the embodiments shown. For example, the yarn guide can alternatively be designed as a belt yarn guide or as a grooved roller. The crossing angle $\alpha$ of the present invention can advantageously assume alternative values in the range of 30° to 40° in end zones 28, 29, and in the central zone 30 in the range of 15° to 28°.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. A method of winding a rotor spun yarn onto a bobbin tube into the form of a conical yarn cheese, the method comprising the steps of traversing a yarn guide along the bobbin tube for winding the yarn onto the bobbin tube at a yarn crossing angle $\alpha$, the traversing of a yarn guide executing a lesser crossing angle $\alpha_M$ in a central zone centrally along the bobbin tube between about 15° and about 28°, and a greater crossing angle $\alpha_R$ in end zones outwardly of the central zone adjacent opposite ends of the bobbin tube, wherein the central zone comprises more than about 50% of the entire wound extent of the cheese.

2. The method in accordance with claim 1, wherein the crossing angle $\alpha_M$ in the central zone has a value between about 20° and about 26°.

3. The method in accordance with claim 1, wherein the crossing angle $\alpha_M$ in the central zone is at least 8° smaller than the maximum crossing angle $\alpha_R$ in the end zones.

4. The method in accordance with claim 1, further comprising the step of reducing a contact pressure of the cheese as the diameter of the bobbin increases.

5. The method in accordance with claim 1, further comprising the step of reducing the yarn tension as the diameter of the bobbin increases.

6. A yarn cheese comprising a rotor spun yarn wound in progressive yarn layers into a conical form on a bobbin tube, each yarn layer having a lesser crossing angle $\alpha_M$ in a central zone centrally along the bobbin tube between about 15° and about 28°, and a greater crossing angle $\alpha_R$ in end zones outwardly of the central zone adjacent opposite ends of the bobbin tube, wherein the central zone having a reduced crossing angle $\alpha_M$ occupies more than about 50% of the entire wound extent of the cheese.

7. The cheese in accordance with claim 6, wherein the crossing angle $\alpha_M$ in the central zone is at least 8° smaller than maximum crossing angle $\alpha_R$ in the end zones.

8. The cheese in accordance with claim 6, wherein the crossing angle $\alpha_M$ in the central zone has a value of between about 20° and about 26°.

* * * * *